US007696430B2

(12) United States Patent
Santos Lopez et al.

(10) Patent No.: US 7,696,430 B2
(45) Date of Patent: Apr. 13, 2010

(54) METALLIC CONDUCTOR AND PROCESS OF MANUFACTURING SAME

(75) Inventors: Luis Santos Lopez, Barcelona (ES); Gerardo Pallares Tuset, Barcelona (ES); Jose Pertegaz Moya, Barcelona (ES); Francisco José Martínez Bragado, Barcelona (ES)

(73) Assignee: Grupo General Cable Sistemas, S.A., Barcelona (ES)

( * ) Notice: Subject to any disclaimer, the term of this patent is extended or adjusted under 35 U.S.C. 154(b) by 0 days.

(21) Appl. No.: 10/550,322

(22) PCT Filed: Mar. 8, 2004

(86) PCT No.: PCT/EP2004/002512

§ 371 (c)(1),
(2), (4) Date: Jul. 10, 2006

(87) PCT Pub. No.: WO2004/086417

PCT Pub. Date: Oct. 7, 2004

(65) Prior Publication Data

US 2006/0254793 A1 Nov. 16, 2006

(30) Foreign Application Priority Data

Mar. 28, 2003 (EP) ..... 03380076

(51) Int. Cl.
*H01B 11/06* (2006.01)

(52) U.S. Cl. ..... 174/36; 174/110 R; 174/117 R

(58) Field of Classification Search ..... 174/36, 174/102 R, 102 C, 105 R, 106 R, 126.1, 126.2, 174/127, 128.1, 128.2, 129 R
See application file for complete search history.

(56) References Cited

U.S. PATENT DOCUMENTS

| | | | | | |
|---|---|---|---|---|---|
| 269,470 | A | * | 12/1882 | Sawyer | 174/103 |
| 1,199,789 | A | * | 10/1916 | Chase | 174/106 R |
| 1,370,731 | A | * | 3/1921 | Chase | 174/103 |
| 1,393,700 | A | * | 10/1921 | Reboul | 30/47 |
| 1,822,737 | A | * | 9/1931 | Karapetoff | 307/147 |
| 1,959,526 | A | * | 5/1934 | Del Mar | 57/7 |
| 2,112,322 | A | * | 3/1938 | Wyatt | 174/14 R |

(Continued)

FOREIGN PATENT DOCUMENTS

CN 1097893 A 1/1995

(Continued)

OTHER PUBLICATIONS

C & M Corporation, Engineering Design Guide, 3th Edition, pp. 1-5, Jan. 1992.*

(Continued)

*Primary Examiner*—William H Mayo, III
(74) *Attorney, Agent, or Firm*—Ladas & Parry LLP

(57) ABSTRACT

A metallic conductor (21) including an assembly of wires (22) having a predetermined polygonal cross-section. A flexible cable (23) is formed from a plurality of the multi-wire conductor (21) having a predetermined polygonal cross-section that are insulated.

17 Claims, 1 Drawing Sheet

U.S. PATENT DOCUMENTS

| | | | | | |
|---|---|---|---|---|---|
| 2,123,746 | A | * | 7/1938 | Rost | 428/373 |
| 2,125,869 | A | * | 8/1938 | Atkinson | 174/103 |
| 2,190,017 | A | * | 2/1940 | Del Mar | 174/25 R |
| 3,307,343 | A | * | 3/1967 | Gilmore et al. | 57/215 |
| 3,914,532 | A | | 10/1975 | Dyba et al. | |
| 4,550,559 | A | * | 11/1985 | Thomson | 57/223 |
| 5,732,875 | A | | 3/1998 | Ziemek et al. | |

FOREIGN PATENT DOCUMENTS

| | | | |
|---|---|---|---|
| GB | 1 362 519 | * | 9/1971 |
| GB | 1 362 519 | A | 8/1974 |
| GB | 1362519 | | 8/1974 |
| GB | 1 387 660 | | 3/1975 |
| GB | 1387660 | | 3/1975 |
| GB | 2 095 459 | | 9/1982 |
| GB | 2095459 | | 9/1982 |

OTHER PUBLICATIONS

Simplified Design of Uniline Arrangement Structure in Sector-Compacting Conductor and of Parallel-Line Mold—Aug. 1994—Electric Wire & Cable No. 4 1994 p. 12-15.

Developing of Large-Section Oil-Filled Cable of 200KV & 1 × 1000M$^2$ Apr. 1999 Electric Wire & Cable No. 2 1999 p. 9-11.

Mathematical Models for Design of Profile Conductor Structures Jun. 2001 Electric Wire & Cable No. 3 2001 p. 17-21.

* cited by examiner

METALLIC CONDUCTOR AND PROCESS OF MANUFACTURING SAME

BACKGROUND OF THE INVENTION

Field of the Invention

The present invention relates, in general, to a metallic conductor composed of a plurality of wires which adopts a predetermined polygonal cross-section.

More concretely, the present invention relates to a metallic conductor suitable for forming an electric and/or communication cable, which is composed of a collected assembly of wires that adopts a predetermined polygonal cross-section, such as a circular sector, in such a way that the predetermined form is maintained over time after the metallic conductor is submitted to an extrusion process.

In general, a multicore cable suitable for carrying electric power is composed of insulated conductors surrounded by a covering for mechanical protection.

The multicore cable assumes a circular cylindrical external shape as a consequence of the polygonal distribution of the multi-wire conductors. For example, in the case when the cable is composed of three conductors, the centres of the latter assume a triangular arrangement inside a circular cylindrical external protective covering that surrounds the arrangement of conductors.

The said multicore cable is said to be flexible since each multi-wire conductor of which it is composed is in turn composed of a collected assembly of wires of copper, aluminium, tinned copper or other alloys in accordance with the requirements of classes V and VI of standard IEC-60228. Obviously each multi-wire conductor is surrounded by a layer of insulating material such as PVC, polyethylene, crosslinked polyethylene, ethylene-propylene, thermoplastic rubbers and halogen-free materials.

It should be pointed out that the triangular arrangement of the multi-wire conductors gives rise to dead spaces that have to be occupied by material corresponding to the protective covering of the flexible cable, the diameter of which is determined by the arrangement of the multi-wire conductors.

Consequently, grouping of several conductors under a single covering leads to an increase of the cross-section of the flexible cable, of its weight and, therefore, of the cost of the said flexible cable, as a result of using a larger quantity of material in the protective covering.

Accordingly, it has become necessary to develop a flexible multi-wire metallic conductor that has a predetermined cross-section in such a way that the overall size of the flexible cable is reduced, and therefore the weight per unit length and the cost are reduced.

BRIEF SUMMARY OF THE INVENTION

One aim of the present invention is to provide a metallic conductor that comprises a collected assembly of wires so that it assumes a predetermined polygonal cross-section such as a circular sector or similar.

Another aim of the invention is to provide a flexible cable, of reduced dimensions, smaller final diameter of the finished cable, and reduced weight per unit length that includes a plurality of insulated multi-wire conductors, since each multi-wire conductor has a predetermined polygonal cross-section.

Another aim of the invention is to provide a cable for which there is reduced consumption of protective materials in its process of manufacture.

Another aim of the present invention is to permit the coiling of a larger number of linear meters of cable on spools employed for coiling cables that contain conductors of circular cross-section.

Another aim of the present invention is to provide a cable that handles easily, i.e. once the protective covering and the insulating covering that surrounds each conductor have been detached, an assembly of wires is obtained that can be easily modified and shaped.

BRIEF DESCRIPTION OF THE DRAWING

A more detailed explanation of the invention is given in the following description, based on the appended drawings in which.

DETAILED DESCRIPTION OF THE INVENTION

Figure 1:
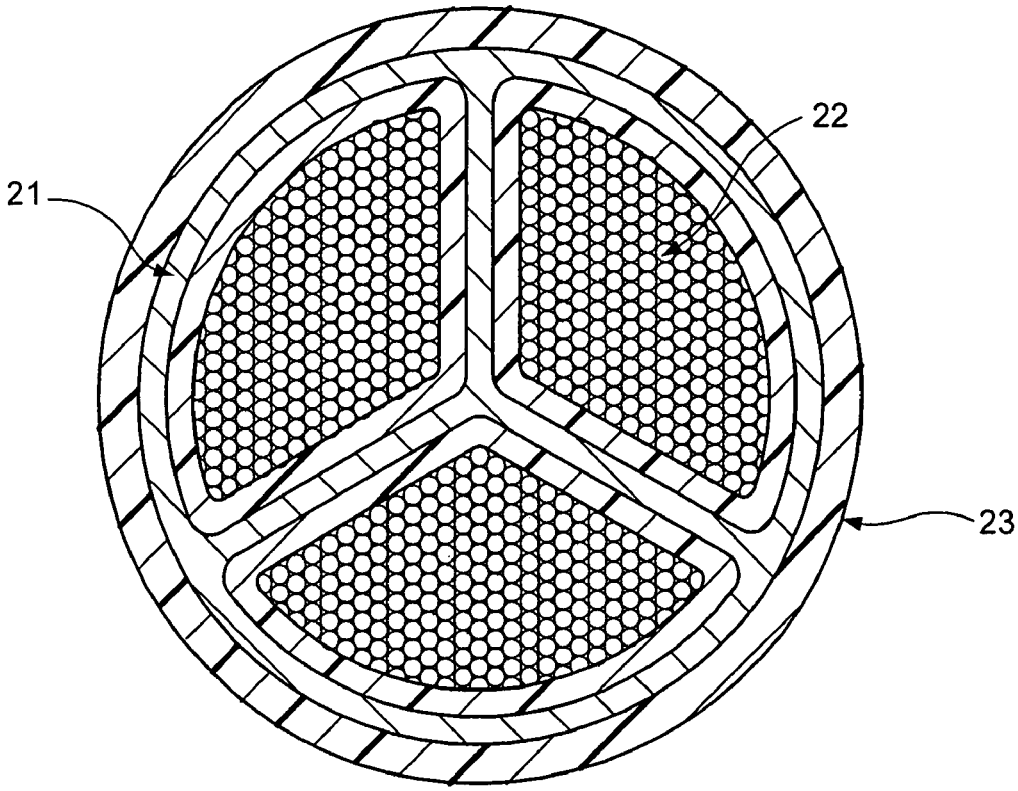
FIG. 1 shows a view of a cross-section of a cable according to the invention.

FIG. 1 shows a cross-section of a cable 23 of insulated phases that comprises metallic conductors 21 which, in their turn, each include a collected assembly of wires 22, so that the conductor 21 has a predetermined polygonal cross-section, such as a circular sector.

Consequently, the polygonal cross-section comprises a combination of at least one straight side and one curved side.

It should be pointed out that each conductor 21 as well as the cable 23 that is formed by grouping several multi-wire conductors 21 under a common protective covering are flexible, since each wire has a diameter less than or equal to 0.61 mm.

Before being grouped under the common covering that forms cable 23, each conductor 21 was enveloped in a layer of an insulating thermoplastic or thermosetting polymeric material such as polyethylene, polyester, fluorinated polymer, polyolefin, polyamide, polyimide, polyurethane, polyvinyl chloride, thermoplastic elastomer, ethylene-propylene, polychloroprene or silicone rubber, as well as their compounds and derivatives which as well as providing electrical insulation makes it possible to maintain the predetermined cross-section that was imparted to it by a mechanical means of deformation.

That is, once it has been formed in a compressing means, each multi-wire conductor 21 is fed to a mechanical means of deformation with the aim that, at its outlet, a multi-wire conductor 21 is obtained with the desired cross-section and this will be fed to an extrusion means, so that at the outlet of the extrusion process the multi-wire conductor 21 is obtained with the desired cross-section.

Compressing has the objective of collecting together all the wires that will form the conductor 21 in a cable-making machine to obtain a circular shape.

It should be pointed out that the mechanical means is able to give conductor 21 the desired shape and ensure that this is maintained until conductor 21 is confined under the insulation until, in its case, the said insulating material is removed or, in some other way, the multi-wire conductor 21 is exposed. This means that the insulating material holds the wires in the form that they were given in the mechanical means of deformation.

Once the various insulated phases that will make up the cable 23 have been obtained, the said phases are cabled in cable-making machines of insulated conductors 21 to obtain a regular cabling of the conductors 21 of polygonal cross-section to obtain a cable 23 of final, overall circular cross-section. The said process is widely known in the state of the art.

For example, the extrusion process of conductor 21 is carried out using vacuum techniques that maintain the original shape of conductor 21 by replication of the insulation.

It should be pointed out that with other cabling techniques it is possible to group several conductors 21 in a cable with a rectangular cross-section, for example a flat cable. Accordingly, cable 23 can comprise conductors 21 of different polygonal cross-sections such as a rectangular section and a semicircular section.

On the other hand, the layer of protective material can comprise several layers with different or with similar physical characteristics, for example it can include a metallic protective material.

Although the invention has been described with reference to one embodiment thereof, numerous changes and modifications of the invention may be obvious to a person skilled in the art, without departing from its spirit and scope, and it is intended that all such changes and modifications are included within the scope of the following claims.

The invention claimed is:

1. A metallic conductor for a low-tension electrical conductor, the metallic conductor comprising an assembly of flexible wires each having a diameter of less than or equal to 0.61 mm; wherein the conductor is arranged in a predetermined polygonal cross-section comprising one curved side and two straight sides, wherein the conductor is surrounded by a layer of an insulating material that holds the wires in the predetermined polygonal cross-section such that the conductor is shape-maintaining whereby it maintains the predetermined polygonal cross-section unless and until the layer of insulating material is removed.

2. A metallic conductor according to claim 1, wherein the polygonal cross-section is a circular sector.

3. A metallic conductor according to claim 1, in which the layer of insulating material is thermoplastic and/or thermosetting, such as polyethylene, polyester, fluorinated polymer, polyolefin, polyamide, polyimide, polyurethane, polyvinyl chloride, thermoplastic elastomer, ethylene-propylene, polychloroprene or silicone rubber, as well as their compounds and derivatives.

4. A low-tension cable comprising a plurality of conductors according to claim 1, each of the conductors being electrically insulated from one another, and grouped together by a cabling process under a covering or a common binding element.

5. A cable according to claim 4, wherein the predetermined polygonal arrangement is a circle.

6. A cable according to claim 5, wherein the cable comprises conductors of different polygonal cross-sections.

7. A cable according to claim 4, wherein the predetermined polygonal arrangement is a rectangle.

8. A cable according to claim 7, wherein the cable comprises conductors of different polygonal cross-sections.

9. A cable according to claim 4, wherein the predetermined polygonal arrangement is surrounded by at least one layer of a protective material.

10. A cable according to claim 9, wherein the layer of protective material is a textile material applied as a protective belt.

11. A cable according to claim 9, wherein the layer of protective material is a metallic protective material.

12. A cable according to claim 11, wherein the predetermined polygonal arrangement is surrounded by a combination of layers of protective material.

13. A cable according to claim 11, wherein the layer of protective material is a thermoplastic and/or thermosetting polymeric protective material.

14. A cable according to claim 4, wherein the cable is sufficiently flexible to meet classes V and VI of IEC-60228 standard.

15. A cable according to claim 4, wherein the cable is sufficiently flexible to permit coiling of the cable on a spool.

16. A method of manufacturing a metallic conductor comprising the steps of:

providing an assembly of flexible wires each having a diameter of less than or equal to 0.61 mm;

deforming, using a mechanical means of deformation, the assembly of flexible wires and arranging the wires to form a metallic conductor having a predetermined polygonal cross-section comprising one curved side and two straight sides, extruding, using an extrusion means, the metallic conductor obtained in the preceding operation; and surrounding the extruded metallic conductor in a layer of insulating material that holds the wires in the predetermined polygonal cross-section such that the conductor is shape-maintaining whereby it maintains the predetermined polygonal cross-section unless and until the layer of insulating material is removed.

17. A flexible electric and/or communication cable consisting of:

a plurality of metallic conductors; each of the conductors comprising a plurality of wires having a diameter of less than or equal to 0.61 mm and an insulating layer enveloping the wires; wherein the wires and the insulating layer are constructed and arranged to form a conductor that has predetermined polygonal cross-section having a curved side and that maintains the predetermined polygonal cross-section unless and until the insulating layer is removed; and a flexible protective sheath covering the plurality of metallic conductors.

* * * * *